US012535218B2

(12) United States Patent
Farrer

(10) Patent No.: US 12,535,218 B2
(45) Date of Patent: Jan. 27, 2026

(54) SYSTEMS AND METHODS FOR A FIRE DISPLAY DEVICE

(71) Applicant: Red Weather Systems Inc., Costa Mesa, CA (US)

(72) Inventor: Trent Farrer, Vancouver, WA (US)

(73) Assignee: RED WEATHER SYSTEMS INC., Costa Mesa, CA (US)

( * ) Notice: Subject to any disclaimer, the term of this patent is extended or adjusted under 35 U.S.C. 154(b) by 759 days.

(21) Appl. No.: 17/815,510

(22) Filed: Jul. 27, 2022

(65) Prior Publication Data

US 2024/0035661 A1 Feb. 1, 2024

(51) Int. Cl.

| | |
|---|---|
| ***F24B 1/199*** | (2006.01) |
| ***F23K 5/00*** | (2006.01) |
| ***F24B 1/195*** | (2006.01) |

(52) U.S. Cl.

CPC ..... *F24B 1/199* (2013.01); *F23K 5/007* (2013.01); *F24B 1/1957* (2013.01); *F23K 2400/201* (2020.05)

(58) Field of Classification Search

None

See application file for complete search history.

(56) References Cited

U.S. PATENT DOCUMENTS 3,922,137 A * 11/1975 Peczeli ..... F23D 1/00 239/406

FOREIGN PATENT DOCUMENTS

| | | | |
|---|---|---|---|
| AT | 393019 B | * | 7/1991 |
| CN | 106524161 A | * | 3/2017 |
| JP | 2020003076 A | * | 1/2020 |

* cited by examiner

*Primary Examiner* — Jason Lau

(74) *Attorney, Agent, or Firm* — McCoy Russell LLP

(57) ABSTRACT

Systems and methods for a fire device, comprising injecting multiple gaseous fuel streams upwards to a focal point via corresponding fuel injection ports, wherein the multiple gaseous fuel streams intersect at the focal point; and igniting the multiple gaseous fuel streams at the focal point via the pilot light flame. Deflections panels are coupled to the fire device, in one or more examples.

13 Claims, 8 Drawing Sheets

SYSTEMS AND METHODS FOR A FIRE DISPLAY DEVICE

FIELD

The present description relates generally to systems and methods for a fire display device.

BACKGROUND/SUMMARY

A fire pit is a vessel for containing a flame, typically used outdoors, and may be considered a type of fire display device. A torch may also be considered a type of fire display device. Fire display devices may be utilized for an entertaining and theatrical effect in which it may be desirable for the flames to be produced in a manner that is highly visible compared to traditional fire display devices. In some examples, such fire display devices may further be coordinated to an audio input, such as music as part of the entertaining and theatrical effect.

Such fire displays devices present certain challenges. For example, it may be difficult to form flames that are easily seen from further distances where the fire pit is visible to the observer. Further challenges may arise in creating defined ignition events in which multiple gaseous fuel streams are ignited at substantially the same time and in shaping the flames into different shapes for theatrical effect, for example.

Traditional ignition configurations may comprise a pilot light that ignites gaseous fuel close to a burner pan, resulting in flames that are closer to the burner pan, spread out, and relatively low in height. Thus, such traditional ignition configurations result in flames that are difficult to see from further distance visually. Furthermore, traditional ignition configurations ignite gaseous fuel in a manner that creates a whipping effect, where gaseous fuel streams are ignited one after the other rather than igniting multiple gaseous fuel streams at substantially the same time. This whipping effect creates a lagging effect that may be undesirable for theatrical display purposes.

In one example, the issues described above may be addressed by fire display systems and methods that comprise injecting multiple gaseous fuel streams toward a focal point and igniting the multiple gaseous fuel streams at the focal point.

Via the above approach where the multiple gaseous fuel streams converge are injected toward a focal point and are ignited at the focal point, the resulting flames were found to have a substantially increased height compared to flames generated via traditional configurations. Furthermore, the multiple gaseous fuel streams are ignited at substantially the same time, avoiding the undesirable whipping effect of traditional configurations. Thus, highly visible flames may be produced resulting in an enhanced entertainment and theatrical effect.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
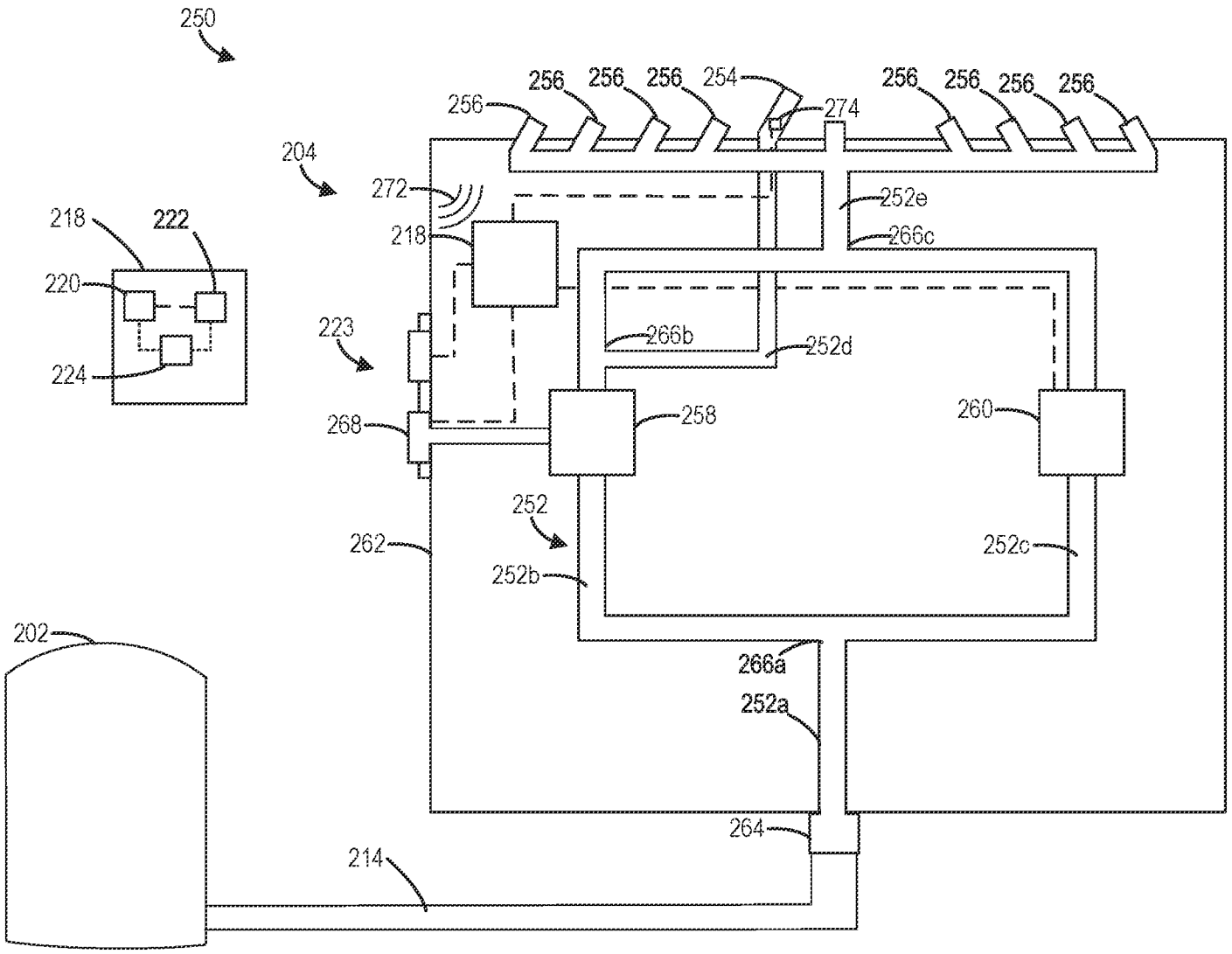
FIG. 2 is a schematic of a fire display device, according to one or more examples of the present disclosure.
Figure 3:
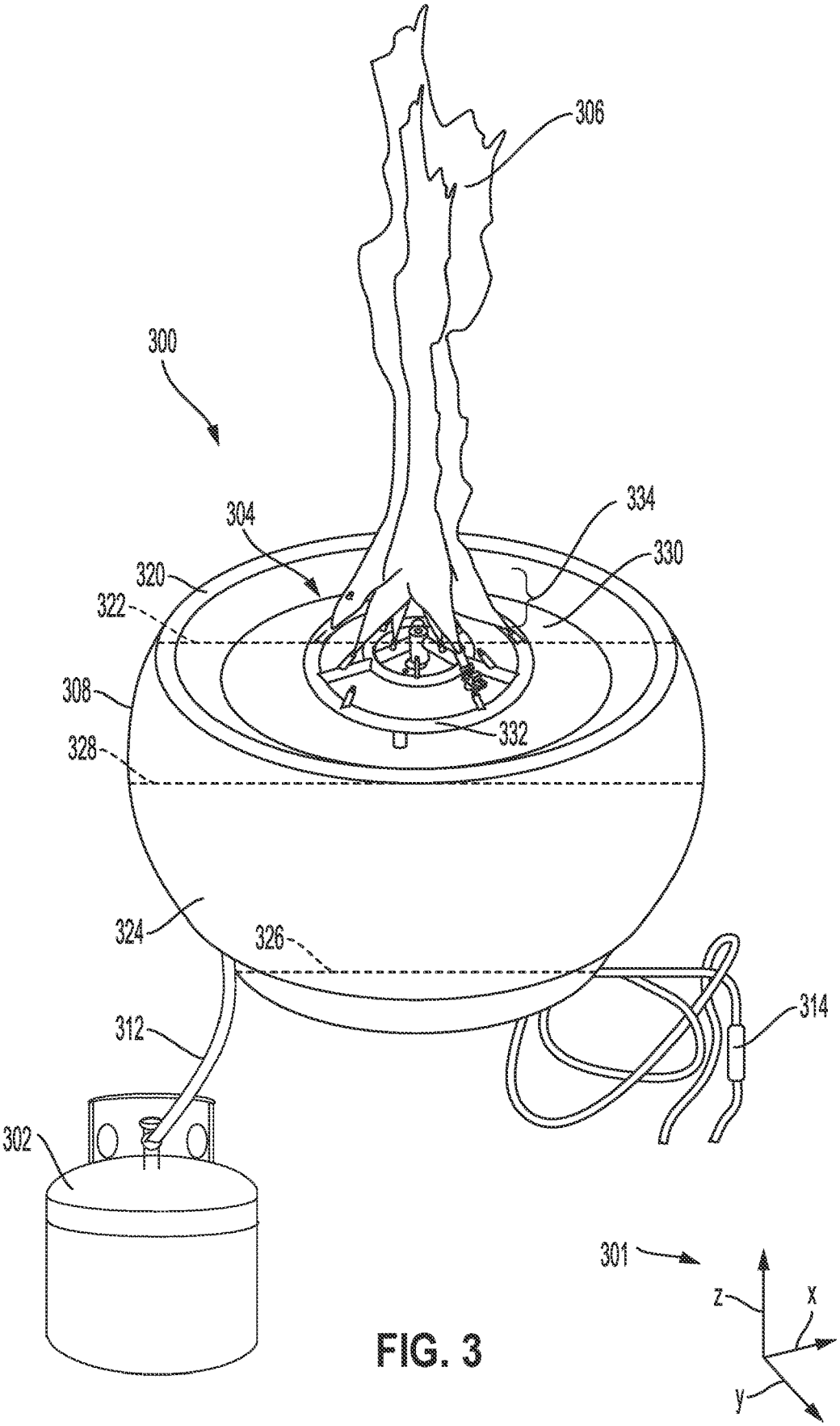
FIG. 3 fire display device in operation, according to one or more examples of the present disclosure.

The following description relates to systems and methods for a fire display which may include multiple fire display devices. An example of multiple fire display devices arranged in a display is shown in a system environment of FIG. 1. One or more of the fire display devices may have a configuration as shown in the schematic of FIG. 2 and produce a highly visible flame as shown at FIG. 3 at least in part due to the ignition configuration shown at FIG. 4A. The height and visibility of the flame may be further increased via a pair of injection ports in one embodiment of a configuration shown in FIG. 5. The fire display may further include deflection panels as shown in FIG. 4B and comprise a control panel such as the one shown in FIG. 6. Further, the fire display device may be controlled by the control panels and audio inputs according to the method shown in FIG. 7.

The fire display device may be referred to as a fire pit. The fire pit may serve as décor and lighting. In large spaces, it is often desirable to have multiple fire pits and, in some cases, one or more additional fire devices such as fire pits on display. Such fire devices may be coordinated with an input, such as an audio input, to provide bursts of flame for an entertaining and theatrical effect.

Moreover, by an ignition configuration in which the fan in which the pilot light is provided at an angle and above the gaseous fuel injectors. The pilot light may therein ignite flame at a set distance at a focal point above the gaseous fuel injectors. The inventors have found that the resulting flames may have a floating effect that is easier to view. This floating effect, also referred to as a ghost flame effect, also helps to emphasize coordination of flames with an audio input, when operated in an audio mode. The flame generated by the ghost flame effect may be referred to as a ghost flame.

For purposes of discussion, the below figures are described collectively. Thus, similar elements may be labeled similarly and may not be re-introduced. FIGS. 3-6 are shown approximately to scale.

Figure 1:
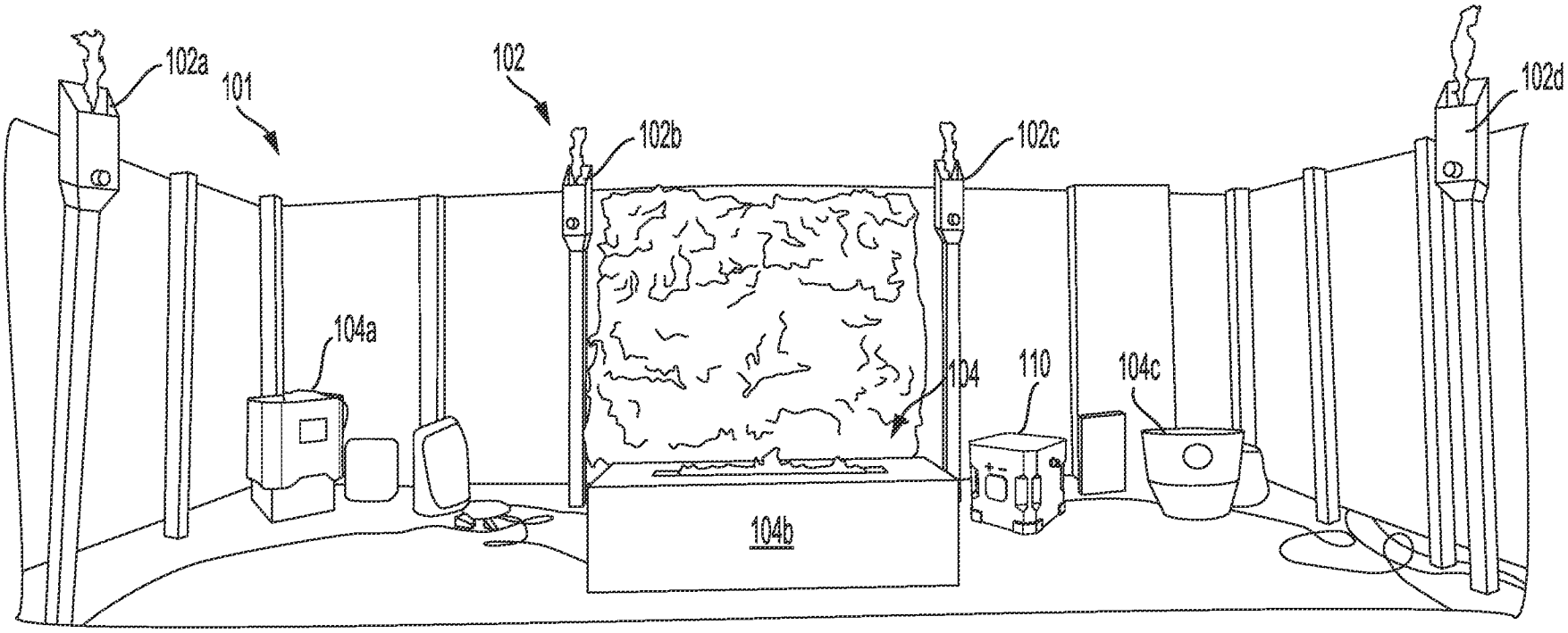
FIG. 1 shows a system environment, according to one or more examples of the present disclosure.

Turning first to FIG. 1, it shows a system environment 100, according to one or more examples of the present disclosure. The system environment 100 is shown in a large warehouse space in the present disclosure. In other examples, however, the system environment 100 may instead be an outdoor environment, such as a backyard. The system environment 100 comprises fire devices including a plurality of torches 102*a*, 102*b*, 102*c*, 102*d* (also referred to as torches 102). Though there are four torches shown in the example at FIG. 1, it is noted that additional torches or fewer torches may be included in the system without departing from the scope of the disclosure.

In addition to the torches 102, the system environment 100 comprises additional fire devices including a first fire pit 104*a*, a second fire pit 104*b*, and a third fire pit 104*c* (also referred to as fire pits 104). As with the torches 102, there may be additional fire pits or fewer fire pits included in the system, in at least one example. The torches 102 and the fire pits 104 together may form a fire display 101. Each of the fire pits 104 and torches 102 may include a fire device controller, wireless receiver, input panel, and a battery as discussed further below with respect to FIG. 2. The fire device controller and audio input may receive signals from a hub 110.

The hub 110 is a controller that comprises a processor with instructions stored in non-transitory memory that, when executed, sends control signals to control one or more of the torches 102 and the fire pits 104. For example, the control signals sent from the hub 110 may be received at fire device controllers and audio inputs of the respective torches 102 and fire pits 104. Each of the torches 102 and fire pits 104 additionally comprises an ignitor and at least one electric valve positioned therein that is configured to adjust an amount of fuel provided for ignition of the respective torch or fire pit.

Responsive to receiving control signals from their respective fire device controllers, the torches 102 and fire pits 104 may then actuate at least one of the electric valve and the ignitor for each of the respective torches 102 and fire pits 104. Via such actuation, a flame size and height may be controlled for the torches 102 and fire pits 104.

The control signals are sent from the hub 110 to one or more of the torches 102 in response to the processor of the hub 110 receiving input signals. The control signals may further be sent from the hub 110 to one or more of the fire pits 104 responsive to such input signals. In at least one example, the processor of the hub 110 receives input signals via one or more of a wireless receiver of the hub 110, a hardwired connection of the hub 110, and a user interface integrated into the hub 110 itself, where the user interface comprises one or more user input devices (e.g., buttons, dials, a touch screen) to receive the input signal.

In at least one example, the hub 110 may be a mobile device of a user, such as a cellular telephone or a laptop of the user. In such examples, it is noted that an application of the mobile device may be used to control the torches 102 and fire pits 104. That is, when the hub 110 is a mobile device, an application of the mobile device may provide a display via the mobile device and receive input signals via a user interface of the mobile device (e.g., buttons, a touch screen).

The input signals received at the hub 110 may include a mode selection received at the hub 110. Additionally or alternatively, a mode election may be received at the input panels of the respective torches 102 and fire display devices 204. For example, the mode selection may include selection of a traditional mode or an audio mode. In the traditional mode, the torches 102 and fire pits 104 are operated with their respective electric valves maintained at a predetermined base position. At the predetermined base position, the electric valves of the torches 102 and the fire pits 104 are at least partially open and allow fuel to flow to their respective burners. If the electric valve of any of the torches 102 and fire pits 104 being controlled in the traditional mode is not at the base position when the traditional mode is selected, then the electric valve is first adjusted to the predetermined base position and maintained in the base position for a duration of the traditional mode. Due to the maintained position of the electric valve, a steady flame size and height is maintained in the traditional mode.

In the audio mode, the torches 102 and fire pits 104 are operated with their respective electric valves being varied in coordination to an audio input, such as music. Thus, responsive to receiving a user input selecting the audio torch mode and further receiving the audio input, the hub 110 may send control signals to the audio input devices of torches 102 and fire pits 104 based on the audio input.

In particular, the hub 110 may send control signals to adjust respective electric valves of the torches 102 and the fire pits 104 in coordination with the audio input. It is noted that the audio input may be received at each fire display device. For example, the audio input may be received at the hub 110 via wirelessly streaming the audio input to the hub 110 via a mobile device or other personal computing device. In such examples, a wireless receiver of the hub 110 may receive the audio input. As another example, the audio input may be received at the hub 110 via an aux input or other wired audio input. In such examples, a mobile device or other personal computing device may provide the audio input to the hub 110 via such an aux input or other wired audio input.

The electric valve may be adjusted to positions more open than the base position of the traditional mode while in the audio mode, based on the audio input. Additionally, the electric valve may be adjusted to positions that are less open than the base position of the traditional mode while in the audio mode, based on the audio input. In this way, flame bursts and decreases in flame size may be created for the fire display. Thus, in contrast to the traditional mode, the torches 102 and fire pits 104 produce flame sizes and heights that are varied throughout the audio mode in coordination with the audio input.

In at least one example, a flame boost mode may further be available, in which a maximum fuel flow is provided to a burner. In some examples, the flame boost mode may be used for purposes of heating an accessory, such as a griddle or grill attachment. The flame boost mode may also be used for purposes of producing a maximum flame height and size, which may be of interest for lighting or theatrical effect, for example. In the flame boost mode, the respective electric valve of the torches 102 or fire pits 104 is actuated to a wide open position. In at least one example, the flame boost mode may further include a mechanical valve providing fuel to the burner to be manually adjusted to a wide open position, in addition to the electric valve being adjusted to the wide open position.

In examples where the flame boost mode is available, it is noted that the wide open position of the electric valve is more open than the base position for the traditional mode. That is, in examples where the fire devices include the flame boost mode, the flame boost mode creates a maximum flame height and size, which is larger than the flame height and size when operating in the traditional mode.

In at least one example, hub 110 allows for there to be separate control of the torches 102 and the fire pits 104. In separate control examples, it is noted that the mode selections for each of the fire pits 104 and the torches 102 may be made individually set. Thus, each of the torches 102 and each of the fire pits 104 is able to have its own mode selected and individually controlled via the hub 110 and/or via the input panel at each of the torches 102 and fire pits 104. In at least on example, it is noted that a mode selected at the input panel may take priority to a mode selected at the hub. For example, if the hub 110 receives a request to operate the torches 102 and fire pits 104 in an audio mode but the input panel of one of the fire pits 104 is set to the traditional mode, then the fire pit set to the traditional mode will be operated in the traditional mode even though the hub 110 is outputting an audio mode control signal. This allows for local control at the input panel of the torches 102 and the fire pits 104 to take priority for a particular torch or fire pit.

Additionally, or alternatively, the hub 110 may control the torches 102 and the fire pits 104 collectively. In collective control examples, the hub 110 may control the torches 102 and the fire pits 104 all together to be in the same mode. For example, in collective control examples, selection of the traditional mode may result in all of the torches 102 and the fire pits 104 being set to the traditional mode. Further, in the collective control examples, selection of the audio mode may result in all of the torches 102 and the fire pits 104 being set to the audio mode. As to selection of the flame boost mode, in the collective control examples, selection of the flame boost mode may result in all of the torches 102 and the fire pits 104 being controlled to have their respective electric valves in a wide open position.

Further, the hub 110 may additionally or alternatively control the torches 102 and fire pits 104 in sub-groups. In such sub-group control, sub-groups of the torches 102 and/or the fire pits 104 may be formed for control of the sub-group to be the same. For example, in sub-group control, the hub 110 may control the torches 102 together as an all torches sub-group and may control the fire pits 104 together as an all fire pits sub-group. Thus, in this example, the mode for the all torches sub-group being selected as the traditional mode would result in the torches 102 all being set to the traditional mode. Alternatively, the mode for the all torches sub-group being selected as the audio mode would result in the torches 102 all being set to the audio mode. Similarly, in this example, the mode for the all fire pits sub-group being selected as the traditional mode would result in the fire pits 104 all being set to the traditional mode. Or, alternatively, the mode for the all fire pits sub-group being selected as the audio mode would result in the fire pits 104 all being set to the audio mode.

In another sub-group control example, the hub 110 may control a portion of the torches 102 as a first torch sub-group, another portion of the torches 102 as second torch sub-group, a portion of the fire pits 104 as a first fire pit sub-group, and another portion of the fire pits 104 as a second fire pit sub-group. Moreover, a sub-group may contain both torches 102 and fire pits 104, in at least one example.

It is noted that if selection of any of the traditional mode, audio mode, and flame boost mode is also determined to initiate ignition at one or more of the torches 102 and fire pits 104, then the hub 110 may further send a control signal to activate respective ignitors of such torches and fire pits.

As described above, a fire display including multiple fire display devices may use multiple fuel containers, one for each fire display device. Further, the multiple fire display devices may not be coordinated devices able to create a desired effect, especially when the intensity of flame at each fire display device may be controlled individually or as a group. A fire display device including a controller and audio input as shown in FIG. 2 below may allow a coordinated display between multiple display devices and a common fuel line may allow multiple devices to be fueled by a single fuel container.

Looking briefly to FIG. 2, FIG. 2 shows an example diagram 250 of the ignition configuration for one or more of the fire display devices 204. Fire display device 204 may include a fuel passage 252 fluidically coupled to a pilot light 254 and a plurality of fuel injection ports 256 via a mechanical valve 258 and an electronic valve 260. Fire display device 204 may be the same or similar to one of the fire pits 104 shown in FIG. 1.

Fuel passage 252, also referred to herein as a split fuel passage, may include an introductory portion 252*a* which may be fluidically coupled to a connector 264 positioned external to a housing 262 of fire display device 204. Connector 264 may be a quick connect coupled to a fuel source 202 via a fuel line 214. The fuel source 202 may be a gaseous fuel source, such as a propane or natural gas fuel source. In one example, connector 264 may be position at a bottom side of the fire display device. Gaseous fuel traveling from the fuel source 202 via fuel line 214 and connector 264 further flows through introductory portion 252*a* towards pilot light 254, and fuel injection ports 256 may reach a first junction 266*a* which may split fuel passage 252 into a mechanical portion 252*b* and an electric portion 252*c*. Mechanical portion 252*b* may further split at second junction 266*b* to include a pilot portion 252*d* fluidically coupled to pilot light 254. Mechanical portion 252*b* and electric portion 252*c* may rejoin at third junction 266*c* to become fuel injection portion 252*e* which is fluidically coupled to the plurality of fuel injection ports 256.

Mechanical valve 258 may be configured to control a flow of gaseous fuel entering fuel injection portion 252*e* from mechanical portion 252*b*. In one example, mechanical valve 258 may be configured at mechanical portion 252*b* to also control the flow of gaseous fuel to pilot light 254. Mechanical valve 258 may be physically coupled to and controlled by user input device 268 positioned outside of housing 262. User input device 268 may be located at input panel 223 as discussed above with respect to FIG. 2. For example, the user input device 268 may be a dial, where turning the dial a first direction may adjust the mechanical valve 258 to a more open position and turning the dial a second direction may adjust the mechanical valve 258 to a more closed position. Thus, via the user input device 268, a user is able to set a base amount of fuel allowed to flow through the mechanical valve 258 into fuel injection portion 252*e*.

Electronic valve 260 may be configured to control a flow of gaseous fuel from electric portion 252*c* into fuel injection portion 252*e*. Electronic valve 260 may be physically and communicatively coupled to control module 218. Control module 218 may include controller 222, battery 224, and wireless receiver 220 with respect to FIG. 2. For example, control module 218 may receive a wireless signal 272 with instructions to control a position of electronic valve 260 to provide flame bursts synchronized with an audio input. In this way, mechanical valve 258 may control a base amount of fuel when fire display device 204 is operated in a traditional mode while electronic valve 260 may be actuated by control module 218 to provide additional fuel resulting in flame bursts coordinated by an audio signal when in audio mode.

In an alternate embodiment, mechanical valve 258 may be controlled electronically by physically and communicatively coupling to control module 218. In this way, mechanical valve 258 may be controlled by wireless signal 272 sent to control module 218 from the control hub as well as a signal generated by user input device 268.

Gaseous fuel reaching pilot light 254 may be ignited by a spark generated by ignitor 274. Ignitor 274 may be physically and communicatively coupled to control module 218 and may be actuated in response to a command from control module 218 and/or input panel 223. Control module 218 may receive a signal from user input device 268 and/or a wireless signal 272 commanding ignition of pilot light 254.

Once ignited, the pilot light may ignite the gaseous fuel flowing from a plurality of fuel injection ports 256 as controlled by both mechanical valve 258 and electronic valve 260. Additional details regarding plurality of fuel injection ports 256 and pilot light 254 may be discussed in further detail below with respect to FIG. 4A, FIG. 4B, and FIG. 5.

The fuel entering the fire display device 204 as described above may be sourced from a common fuel line which may be divided by a plurality of pressure junctions to deliver fuel to a plurality of fire display devices Turning to FIG. 3, a fire pit 300 in operation is shown, according to one or more examples of the present disclosure. The fire pit 300 may be the same or similar to the fire pits shown in FIG. 1 and fire pit 300 may comprise an ignition configuration as shown in FIG. 2. For reference, axes 301 are further included in FIG. 3-6. Axes 301 are provided for comparison between views shown. The reference axes 301 indicate a y-axis, an x-axis, and a z-axis. In one example, the z-axis may be parallel with a direction of gravity and the x-y plane may be parallel with a horizontal plane that the fire pit 300 may rest upon.

As seen in FIG. 3, the fire pit 300 produces a flame 306 in the form of a burst above the fire pit 300. The flame 306 may be set to pulsate to music, a rhythm, or as part of a programmed display included in the non-transitory memory of a controller (e.g., control module 218) of the fire pit 300. The flame 306 is above the enclosure 308 along the z-axis.

For the example shown in FIG. 3, the enclosure is shown rounded in shape, though it is noted that other shapes for the enclosure 308 may be possible. The enclosure 308 of fire pit 300 may comprise a material resistant to flammability or deformation from high temperatures, such as ceramic or nylon glass. The enclosure 308 may further house the control module 218 as well as the one or more of the other ignition configuration components shown within housing 262 in FIG. 2.

Enclosure 308 comprises a burner bed 320 of a first diameter 322 at the top of the enclosure 308 and fire pit 300 along the z-axis. The burner bed 320 is a concave depression that extends into the enclosure 308 down along the z-axis towards a base 324 of the enclosure 308. The enclosure 308 further comprises a base 324 of a second diameter 326. The enclosure 308 may further include a third diameter 328, where the third diameter 328 is a maximum diameter of the enclosure 308, and where the third diameter 328 is greater than both the first diameter 322 of the burner bed 320 and the second diameter 326 of the base 324. The base 324 has a predetermined minimum diameter in the second diameter relative to the first diameter 322 and the third diameter 328 of the enclosure 308. The diameter of the enclosure 308 above the third diameter gradually decreases towards the first diameter 322 in the upward direction along the z-axis. The diameter of the enclosure 308 below the third diameter 328 gradually decreases to the second diameter 326 in the downward direction along the z-axis. However, it is to be appreciated that the geometry of the enclosure 308 and burner bed 320 may be non-limiting, and other embodiments with different geometries have been contemplated and considered.

As illustrated in FIG. 3, the burner bed 320 may support burner 304. The burner 304 may be circular and positioned such that it is substantially centered on a top surface of the enclosure 308. The burner 304 may further be facing upward, away from the base 324. Therein, the z-axis or a line parallel to the z axis may be normal to the burner 304. When the fire pit 300 is operating, the burner 304 produces the flame 306.

FIG. 3 also shows a fuel hose 312 may be coupled to the fire pit 300. The fuel hose 312 may be fluidically coupled and sealed to a fuel source 302. The fuel source may comprise a gaseous fuel, such as propane, and may be the same or a similar fuel source as fuel source 202 shown in FIG. 2. The fuel source may supply fuel to the fire pit 300 through the fuel hose 312. The fuel hose 312 may have a plurality of connection points for a plurality of fire pits 300.

FIG. 3 shows the burner 304 may comprise a burner pan 330 and a burner rings 332, where the burner rings 332 may be configured as concentric rings. Though multiple burner rings 332 are shown, it is noted that there may only be one burner ring without departing from the scope of the present disclosure. It is also noted that at least one burner ring of the burner rings 332 may couple the burner pan 330. The burner pan 330 may also be referred to herein as a burner plate. The burner pan 330 may be positioned above the burner bed 320 along the z-axis, where the burner pan 330 rests upon and may be supported by the burner bed 320. The burner rings 332 may further rest upon and be supported by the burner pan 330 and burner bed 320. In at least one example, the burner rings 332 may be coupled to the burner pan 330.

The burner pan 330 may be used to deflect thermal energy and may also reflect light from the flame 306, therein increasing the brightness. The burner pan 330 may be made of a reflective metal, such as stainless steel, in one or more examples. For the example shown in FIG. 3, the burner pan 330 may deflect and distribute thermal energy around the burner 304. The burner pan 330 in FIG. 3 may also deflect thermal energy toward the flame 306. For the example shown in FIG. 3, the burner pan 330 may be approximately circular in shape. However, it is to be appreciated that the shape of the burner pan 330 may be non-limiting, and other embodiments with different geometries have been contemplated and considered. It is also to be appreciated that the shape of the burner pan 330 may be dependent on the geometry of the burner bed 320.

The burner rings 332 are concentric and tubular rings fluidically coupled to the fuel source 202 and configured to supply fuel to the flame 306 shown in FIG. 3 for ignition via a pilot light. Though the pilot light is not visible in FIG. 3, such a pilot light may be the same or similar to pilot light 412 shown in FIG. 4A and FIG. 4B. The burner rings 332 may comprise a heat resistant material such as a metal, including stainless steel, in one or more examples. The burner rings 332 may further comprise a plurality of fuel injection ports (e.g., fuel injection ports 256) configured to direct gaseous fuel flowed through the burner rings 332 towards a center of the burner rings 332. The gaseous fuel flowed to the center of the burner rings 332 via the fuel injection ports are ignited via the pilot light to produce flame 306. Further details as to the burner 304 are shown in FIG. 4A-4B and FIG. 5.

Flame 306 may be suspended above the burner rings 332 at a threshold distance. In one or more examples, the threshold distance may be a predetermined distance from the fuel injectors, such as fuel injection ports 256. Flame 306 may be referred to as a ghost flame. Wherein, the fuel supplied to the flame has an unignited portion of fuel at a set distance 334, e.g. the threshold distance, from the fuel injection ports 256. The fuel supplied may be ignited at a focal point, (e.g., focal point 440 of FIG. 4A, FIG. 4B, and FIG. 5). The distance 334 of flame 306 above the fire pit 300, allows flame 306 to be less obscured to an observer by the depression of the burner bed 320 and features of the burner 304, such as the burner rings 332. The ghost flame may be discussed in further detail herein below.

FIG. 3 also shows electricity may be supplied through an electrical cord 314 electrically coupled to the fire pit 300. Electricity may be used power the control module 218 and adjust valves, such as the electronic valve 260, in the fire pit 300 so the flame 306 may pulsate to music. Electricity may also be used to power additional components of the control module 218, including electronics and display interfaces. However, electricity may also be delivered from a battery housed within the fire pit 300 and enclosure 308.

Figure 4A:
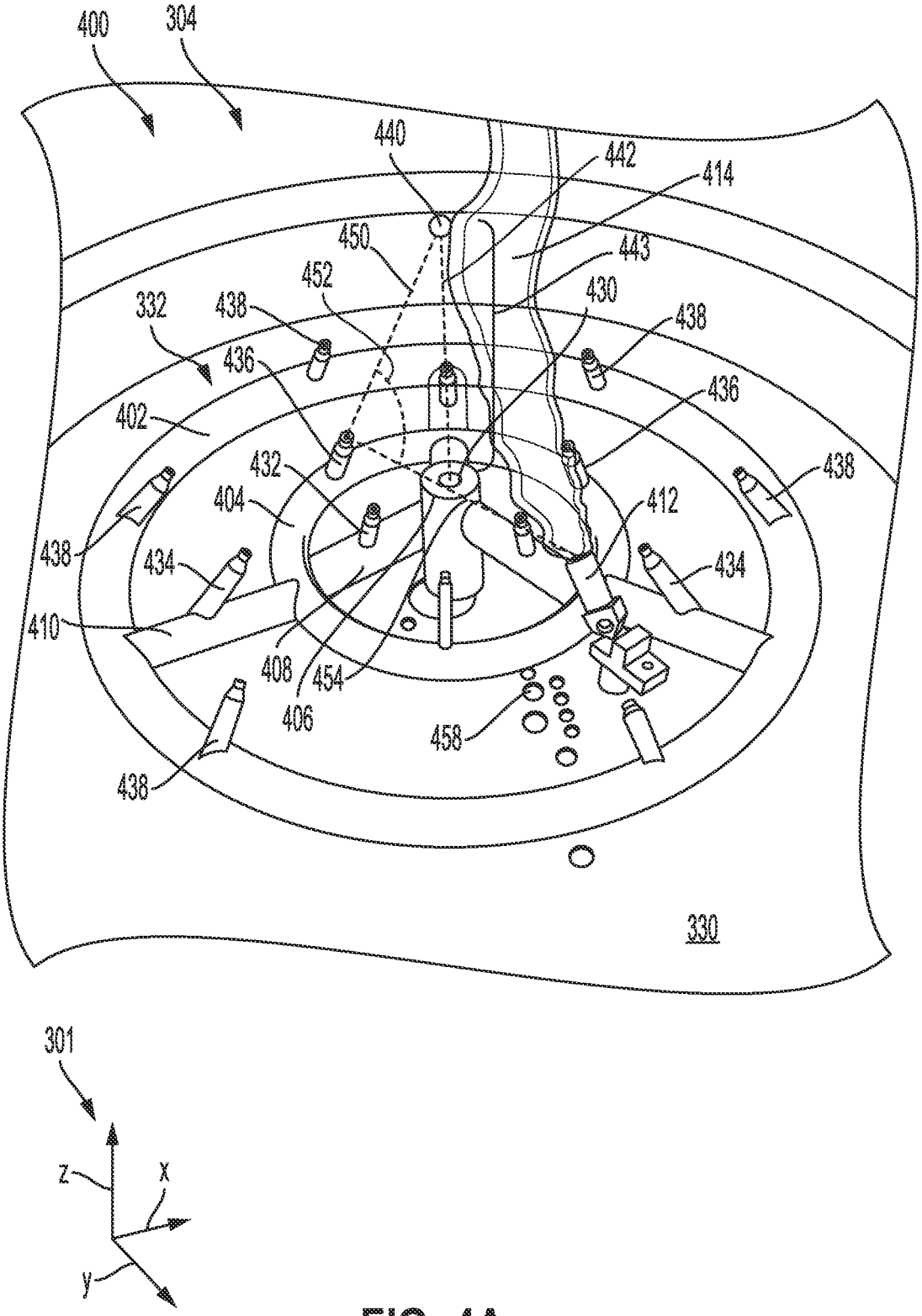
FIG. 4A shows an ignition configuration for a fire pit without deflection panels, according to one or more examples of the present disclosure.
Figure 4B:
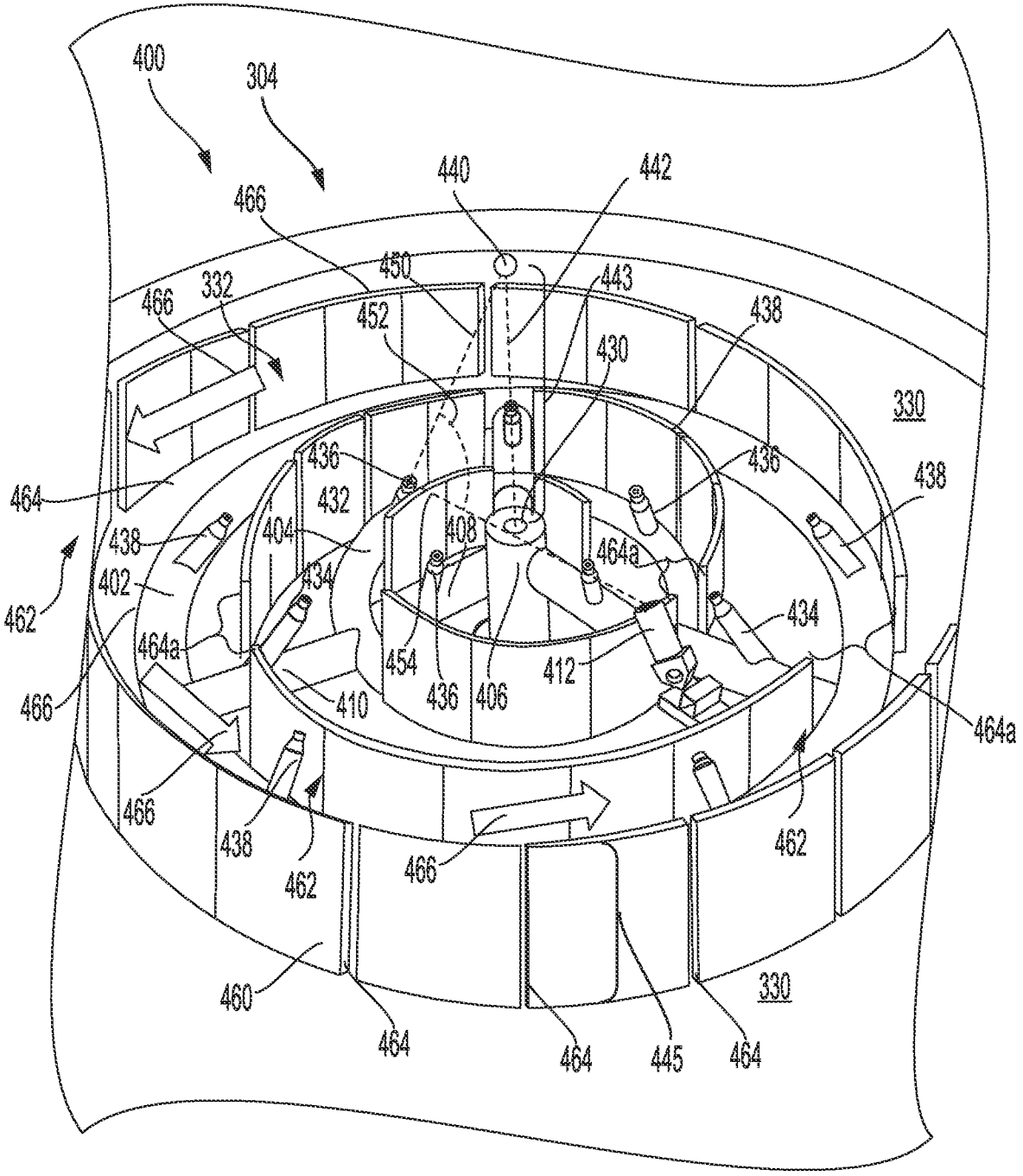
FIG. 4B shows an ignition configuration for a fire pit with deflection panels, according to one or more examples of the present disclosure.
Figure 4B:
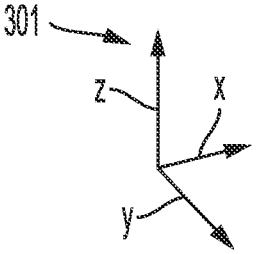
Figure 5:
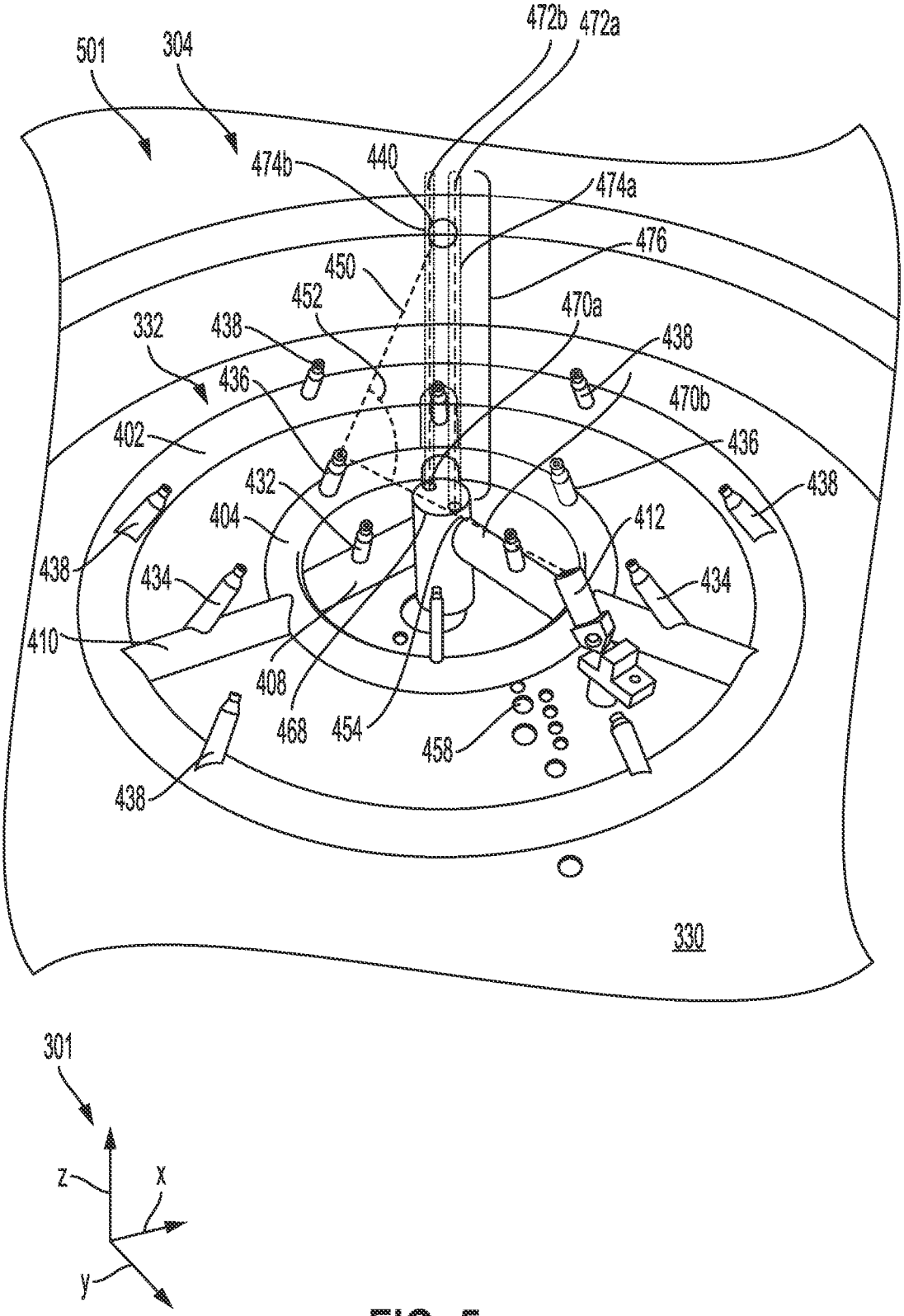
FIG. 5 shows an ignition configuration for a fire pit with a center post of an alternate embodiment, according to one or more examples of the present disclosure.

Turning to FIG. 4A, FIG. 4A a detailed view of a burner 400 is shown. In at least one example, burner 400 may be the same or similar to the burner 304 shown in FIG. 3.

FIG. 4A shows the burner rings 332 of burner 400 may comprise an outer ring 402 and an inner ring 404. Wherein, the inner ring 404 may act as an inner burner ring and the outer ring 402 may act as an outer burner ring. In the center of the inner ring 404 is a center post 406. It is noted that the outer ring 402 and the inner ring 404 are concentric rings. FIG. 4A shows the center post 406 may be connected to the inner ring 404 through a plurality of first spokes 408. FIG. 4A shows the center the inner ring 404 may be connected to the outer ring 402 through a plurality of second spokes 410. The burner rings 332, the center post 406, the plurality of first spokes 408, and the plurality of second spokes 410 may be fluidically coupled to one another and to a fuel source (e.g., fuel source 202). Wherein, the center post 406 may extend through at least one opening in the burner pan 330 to fluidically couple a portion of a fuel passage, such as the fuel injection portion 252*e* of split fuel passage 252. In this way, the burner 304 is configured to flow gaseous fuel from the fuel source and through the burner rings 332, the center post 406, the plurality of first spokes 408, and the plurality of second spokes 410. It is noted that there may only be one burner ring, in at least one example.

A pilot light port 412 is positioned between the inner ring 404 and outer ring 402 in the ignition configuration of FIG. 4A. For the example shown in FIG. 4A, the pilot light port 412 creates a flame herein referred to as a pilot light flame 414. For the example shown in FIG. 4A, the pilot light 412 produces a pilot light flame 414 as an isolated and singular source of a flame. However, in other examples fuel injection ports (e.g., fuel injection ports 256 in FIG. 2), may deliver fuel and create a flame similar to the flame 306 in FIG. 3. Wherein each fuel injection port injects a separate gaseous fuel stream. The fuel injection ports of FIG. 4A may be the same or similar to fuel injection ports 256 shown in FIG. 2.

FIG. 4A shows the burner may comprise a plurality of fuel injection ports (e.g., fuel the fuel injection ports 256 of FIG. 2 or similar fuel injection ports) for distributing fuel to a focal point 440 for ignition. The focal point 440 may be vertically above the concentric burner rings 332 and the fuel injection ports 256. In at least one example, the focal point 440 may be directly above the center post 406. By angling all of the fuel injection ports 256 to inject gaseous fuel to the focal point 440, multiple gaseous fuel streams from each of the fuel injection ports 256 may converge at the focal point 440 and be ignited by directing the pilot light flame to ignite fuel at the focal point 440. Such convergence and ignition of the gaseous fuel at the focal point 440 may result in particularly tall flames. In contrast, previous burners have been concerned with providing flames that are spread out, rather flames that are tall.

The focal point 440 may be positioned above the center post 406 at a distance 443 along fuel injection path 442. For one or more examples distance 443 may be the same or similar to distance 334 of FIG. 3. The fuel injection ports may comprise a plurality of inner ring fuel injectors 436 and a plurality of outer ring fuel injectors 438. Additionally, the fuel injection ports may comprise a plurality of first spoke fuel injectors 432, second spoke fuel injectors 434, and a center fuel injector 430 on the center post 406.

The first spoke fuel injectors 432 may be located on the top of first spokes 408 of the burner rings 332 along the z-axis in FIG. 4A. The first spoke fuel injectors 432 may further be located at substantially at a center along a length of the first spokes 408. FIG. 4A shows that the plurality of first spoke fuel injectors 432 may be angled to inject gaseous fuel towards the focal point 440.

Similar to the first spoke fuel injectors 432, the second spoke fuel injectors 434 may be located on the top of the second spokes 410 of the burner rings 332 along the z-axis in FIG. 4A. The second spoke fuel injectors 434 may further be located substantially at a center along the length of the first spokes 408. FIG. 4A shows that the plurality of second spoke fuel injectors 434 may be angled to inject gaseous fuel towards the focal point 440.

The inner ring fuel injectors 436 may be located on the top of the inner ring 404 of the burner rings 332 along the z-axis. FIG. 4A shows the inner ring fuel injectors 436 are located at substantially equidistant positions along the circumference of the inner ring 404. The plurality of inner ring fuel injectors 436 may be angled to inject gaseous fuel towards the focal point 440. The plurality of inner ring fuel injectors 436 may form a first group of fuel injection ports.

The outer ring fuel injectors 438 may be located on the top of the outer ring 402 of the burner rings 332 along the z-axis. FIG. 4A shows the outer ring fuel injectors 438 may be located at substantially equidistant positions along the circumference of the outer ring 402. FIG. 4A shows that the plurality of outer ring fuel injectors 438 may be angled to inject gaseous fuel towards the focal point 440. The plurality of outer ring fuel injectors 438 may form a second group of fuel injection ports.

The center fuel injector 430 may be a part of the center post 406 and be referred to herein as a post fuel injector port. The center fuel injector 430 may be located directly below the focal point 440 along the z-axis. The center fuel injector 430 also be configured to inject gaseous fuel to the focal point 440, wherein the length of a gaseous fuel stream may be parallel with the z axis. Therein, a fuel injector, (e.g., the center fuel injector 430), may positioned at substantially a center of the burner rings 332.

The fuel injectors ports, including first spoke fuel injectors 432, second spoke fuel injectors 434, inner ring fuel injectors 436, and outer ring fuel injectors 438 may be configured such that a fuel injection path of each of these fuel injection ports intersects with the focal point 440. An example of a fuel injection path 450 extends from an inner ring fuel injector 436 at angle 452 from a line 454 substantially parallel with the y axis. There may be a plurality of fuel injection paths similar to fuel injection path 450 extending from the inner ring fuel injectors 436 at angles similar to angle 452. There may be a plurality of fuel injection paths similar to fuel injection path 450 of a different length extending from first spoke fuel injectors 432 at a different angle than angle 452. There may be a plurality fuel injection paths similar to fuel injection path 450 of a different length extending from second spoke fuel injectors 434 at a different angle than angle 452. There may be a plurality fuel injection paths similar to fuel injection path 450 of a different length extending from outer ring fuel injectors 438 at a different angle than angle 452. A second example of a fuel injection path 442 may be parallel with the z-axis and direct gaseous fuel to the focal point 440 from the center fuel injector 430. Similar to the fuel injectors 430, 432, 434, 436, 438, the pilot light 412 may be angled and deliver fuel along a path towards the focal point 440.

Turning to FIG. 4B, the burner 400 of FIG. 4A is shown with a plurality of deflection panels 460. The deflection panels 460 may at least partially surround the outer ring 402 and inner ring 404 of the burner. The deflection panels 460 may be of a height of 445. The deflection panels 460 may further form an overall shape or pattern. For one example of the present disclosure, the deflection panels 460 in FIG. 4B may be arranged to form a substantially spiral configuration and/or shape with channels 462 defined between the deflection panels 460. Additionally, the shape or pattern formed by the deflection panels 460 is not continuous and may be broken by spaces 464 between the deflection panels 460. Larger spaces 464*a* separate deflection panels 460 where portions of first and second spokes 408, 410 and/or the inner and outer rings 404, 402 are located between. The substantially spiral shape formed by the deflection panels 460 may cause flames produced by the burner 304 to travel above a path indicated by arrows 466 to form a spiral shape. In particular, the deflection panels 460 and channels 462 may help contribute to a flame or flame burst of a substantially spiral shape upon ignition of gaseous fuel. The deflection panels 460 may be coupled via one or more of magnets, a welded connection, or physical couplings (such as threaded fasteners).

As shown in FIG. 4B, the spiral shape formed by the deflection panels 460 and channels 462 starts beyond the outer ring 402 and terminates between the inner ring 404 and center post 406. The width of the channels 462 and distance between deflection panels 460 may decrease as the spiral approaches center post 406 along the x-axis and y-axis. As shown in FIG. 4B, the height of the deflection panels 460 are substantially similar. However, it is to be appreciated that the dimensions of the deflection panels 460 and channels 462 may vary, and other embodiments of deflection panels 460 and channels 462 of different dimensions have been considered. For other examples the deflection panels 460 and channels 462 may be of a smaller size or a larger size. A height of the deflection panels 460 may be varied to further influence the shape of the flames produced by burner 304.

For other examples the deflection panels 460 and channels 462 may be of a different shape to produce other flame shapes via burner 304. Such other shapes formed by the deflection panels 460 may include a cross or a star, among other possible shapes.

The deflection panels 460 may be modular allowing for panels to be rearranged and the spaces 464 to be enlarged, in at least one example. Ends of the deflection panels 460 may be separated from one another by spaces 464 so as not to interfere with spokes 408, 410, the inner and outer rings 404, 402, or other features of the burner 304 the shape formed by the panels 460 crosses.

Gaseous fuel from the fuel injectors 432, 434, 436, and 438 may travel along the fuel injection path 450 above the deflection panels 460 to a focal point 440. The deflection panels 460 may be configured to avoid intersecting with the fuel injection paths (e.g., fuel injection path 450) from the fuel injectors 432, 434, 436, and 438 to focal point 440 for ignition. As such, the height 445 of the deflection panels 460 may be low enough to avoid intersecting with the fuel injection paths, as shown in FIG. 4B.

In FIG. 4B, for one example the pilot light 412 is not igniting fuel injected toward the focal point 440 to show the features of the deflection panels 460. Therein, the ignitor, e.g. ignitor 274, may be off. For another example, pilot light 412 may not inject and ignite fuel toward the focal point 440. For another example, the pilot light 412 may inject and ignite gaseous fuel producing a pilot light flame similar to pilot light flame 414.

For the first example, as noted above, the channels 462 and deflection panels 460 may channel air along a path 466, swirling air about a focal point. The path of the air through the channels 462 may shape a flame ignited by the fuel and pilot light flame at the focal point 440 into a substantially swirl shape. Air may flow in an opposite path to the arrows 466 through the channels 462 so oxygen may be pulled toward and react with the ignited fuel at the focal point 440. However, oxygen in the channels 462 may be blocked or delayed by the deflection panels 460 from traveling to the focal point 440 along a direct path and react with a flame. Therein, a flame ignited at the focal point 440 may expand along a path with the arrows 466 above deflection panels 460 to more easily react with oxygen in the channels 462.

The center post 406 shown in FIG. 4A and FIG. 4B is fluidically coupled to the fuel injection portion of a split fuel passage. For example, center post 406 may be fluidically coupled to a fuel injection port that is similar to or the same as the fuel injection portion 252*e* of the split fuel passage 252 shown in FIG. 2. Therein, the center fuel injector 430 of FIG. 4A and FIG. 4B may be coupled to the injector portion of the split fuel passage by the center post 406. The center post 406 may fluidically couple the burner rings 332 to the fuel injection portion 252*e* of the split fuel passage 252. The plurality of first spokes 408 may further fluidically couple the center post 406 to the inner ring 404, and a plurality of second spokes 410 may fluidically couple the inner ring 404 to the outer ring 402. Therein, the burner rings 332 in FIG. 4A and FIG. 4B may fluidically couple the first spoke fuel injectors 432, the second spoke fuel injectors 434, the inner ring fuel injectors 436, and the outer ring fuel injectors 438 to the fuel injection portion 252*e* of the split fuel passage 252.

The pilot light port 412 may inject fuel and ignite fuel to create a pilot light flame 414. The pilot light flame 414 may be directed toward the center of and serve as an ignition source for the burner 304. For the examples shown in FIG. 4A and FIG. 4B, the ignition of fuel by an ignitor (e.g., ignitor 274) creates the pilot light flame 414.

For the examples shown in FIG. 4A and FIG. 4B, the pilot light 412 may produce a pilot light flame 414 as an isolated and singular source of a flame. However, in other examples the fuel injectors 430, 432, 434, 436, and 438 provide fuel to be ignited by the pilot light flame 414 and create a flame similar to the flame 306 in FIG. 3. The pilot light 412 is angled towards the focal point 440.

In FIG. 4A and FIG. 4B, when the pilot light 412 is on, a pilot light flame 414 may be directed toward the focal point 440. The pilot light flame 414 may be used to ignite other streams of fuel from the fuel injectors 430, 432, 434, 436, and 438 of the burner 304. For the previous example, when fuel is directed toward the focal point 440 by the fuel injectors 430, 432, 434, 436, and 438, and the pilot light 412 is on, the pilot light flame 414 may ignite the fuel at or near the focal point 440.

A flame, such as flame 306, may be ignited and generated at focal point 440 by the pilot light flame 414. In at least one example, one or more of the fuel injectors 430, 432, 434, 436, and 438 may be configured to inject the gaseous fuel at greater than a threshold rate, such that a ghost flame effect is created. The ghost flame effect is an effect where the flame 306 appears to be suspended a distance, such as distance 443, away from the fuel injectors 430, 432, 434, 436, and 438, and in particular, where the flame 306 appears to be suspended at a distance 443 of fuel injection path 442 above the center post 406. This is due to a first portion of the gaseous fuel streams not being ignited (also referred to herein as the unignited portion) and a second portion of the gaseous fuel stream being ignited (also referred to herein as the ignited portion). The unignited portion of the extends from the respective one or more fuel injectors 430, 432,434, 436, and 438 to the ignited portion of the gaseous fuel stream between the one or more fuel injectors 430, 432, 434, 436, and 438. In particular, the one or more fuel injectors 430, 432, 434, 436, and 438 injecting the gaseous fuel at greater than the threshold rate, pilot light flame 414 is unable to ignite a portion of the gaseous fuel streams. The unignited portion of the gaseous fuel streams extends from the one or more fuel injectors 430, 432, 434, 436, and 438 for a distance that may be a predetermined distance, where the gaseous fuel may be injected at a rate to provide the predetermined distance for the unignited portion of the gaseous fuel stream. Thus, should the flame ignited by the pilot light flame 414 may be referred to as a ghost flame, where the ghost flame has an unignited portion for at least a threshold distance, (e.g. the distance of fuel injection paths, such as fuel injection path 442 and fuel injection path 450), from the fuel injectors 430, 432, 434, 436, and 438. In one or more examples, it is noted that the threshold distance of the fuel injection paths to the focal point 440 may be a predetermined distance. For one example, the threshold distance above the center post 406 along fuel injection path 442 may be two inches to three inches. In other examples the distance of other fuel injection paths, such as fuel injection path 450, and fuel injection path 442 from the fuel injection paths of fuel injectors 430, 432, 434, 436, and 438 may be greater than three inches, for example. If the pilot light 412 and/or pilot light flame 414 were positioned too close to the fuel injectors 430, 432, 434, 436, and 438 it is noted that the floating appearance of the ghost flame would be prevented.

In FIG. 4A and FIG. 4B, burner pan 330 may be configured to cover a top portion of the fire display device. The burner rings 332, center post 406, and pilot light port 412 may all extend through and above burner pan 330 along the z-axis. At least one burner ring may be coupled to the burner pan 330 or a similar burner plate. Additionally, first spoke fuel injectors 432, second spoke fuel injectors 434, inner ring fuel injectors 436, and outer ring fuel injectors 438 may be located above the burner pan 330 along the z-axis on the burner rings 332. The burner pan 330 may include a plurality of openings 458 which help to ensure adequate air flow for the flame. For other configurations, the burner pan 330 may have at least one opening similar to openings 458.

For the example in FIG. 4A and FIG. 4B fuel is shown being supplied to and through the pilot light port 412 while the fuel injection ports 256 are prevented from injecting. For the example in FIG. 4A and FIG. 4B, the electronic valve 260 and the mechanical valve 258 shown in FIG. 2 are shut to the fuel injection portion 252*e* and the center post 406 so that the fuel injection ports 256 may be shut off and not delivering fuel to the focal point 440.

However, in FIG. 4A and FIG. 4B the mechanical valve 258 is open to the pilot light 412. The pilot light 412 may use an ignitor, such as ignitor 274 from FIG. 2, to create the pilot light flame 414. The ignitor 274, may be a device, such as a thermocouple, that produces a spark to ignite fuel exiting the pilot light 412. Therein, a pilot light flame 414 may be created. That is, in the example shown in FIG. 4A and FIG. 4B, a pilot light flame 414 is isolated from sources of fuel that are not ignited through the pilot light 412. Fuel may further be delivered to the focal point 440 by the fuel injection ports 256 on the burner rings 332 to create additional flames at FIG. 4A and FIG. 4B.

For this example, a similar quantity fuel may be dispensed to focal point 440 as the quantity dispensed in FIG. 3. Thus, the flames produced by ignition of fuel with the pilot light flame 414 in FIG. 4A and FIG. 4B may similar in size and brightness to the flame 306 in FIG. 3.

Turning to FIG. 5, an example burner 501 is shown which may be the same or similar to burner 400 but with an alternative center post 468. In at least one example, it is noted that deflectors similar to those shown in FIG. 4B may also be coupled to the burner 501 of FIG. 5. In FIG. 5, the pilot light 412 is shown not igniting fuel injected toward the focal point 440 to more clearly illustrate the features of the center post 468. For another example, the pilot light 412 may ignite a pilot light flame 414. FIG. 5 shows for one example center post 468 comprises two injection openings: a first fuel injector opening 470*a* and a second fuel injector opening 470*b*, that may also be referred to herein as a first fuel injector and a second fuel injector, respectively. The first fuel injector opening 470*a* and second fuel injector opening 470*b* may also be referred to herein as twin tail injectors or a pair of tail injectors.

As shown in FIG. 5, the first fuel injector 470*a* may inject a first fuel stream 474*a* along a first path 472*a*, and the second fuel injector 470*b* may inject a second fuel stream 474*b* along a second path 472*b*, toward the focal point 440. The first and second path 472*a*, 472*b* and the first and second fuel streams 474*a*, 474*b* may extend a distance 476 above the center post 468.

The first and second fuel injectors 470*a*, 470*b* may be a smaller diameter compared to center fuel injector 430 of FIG. 4A and FIG. 4B, in at least one example. Therein, gaseous fuel may be passed through the first and second fuel injectors 470*a*, 470*b* at a higher pressure compared to gaseous fuel that may be injected from center fuel injector 430. The result of FIG. 5 may thus be an increased height of the flames and brightness.

Figure 6:
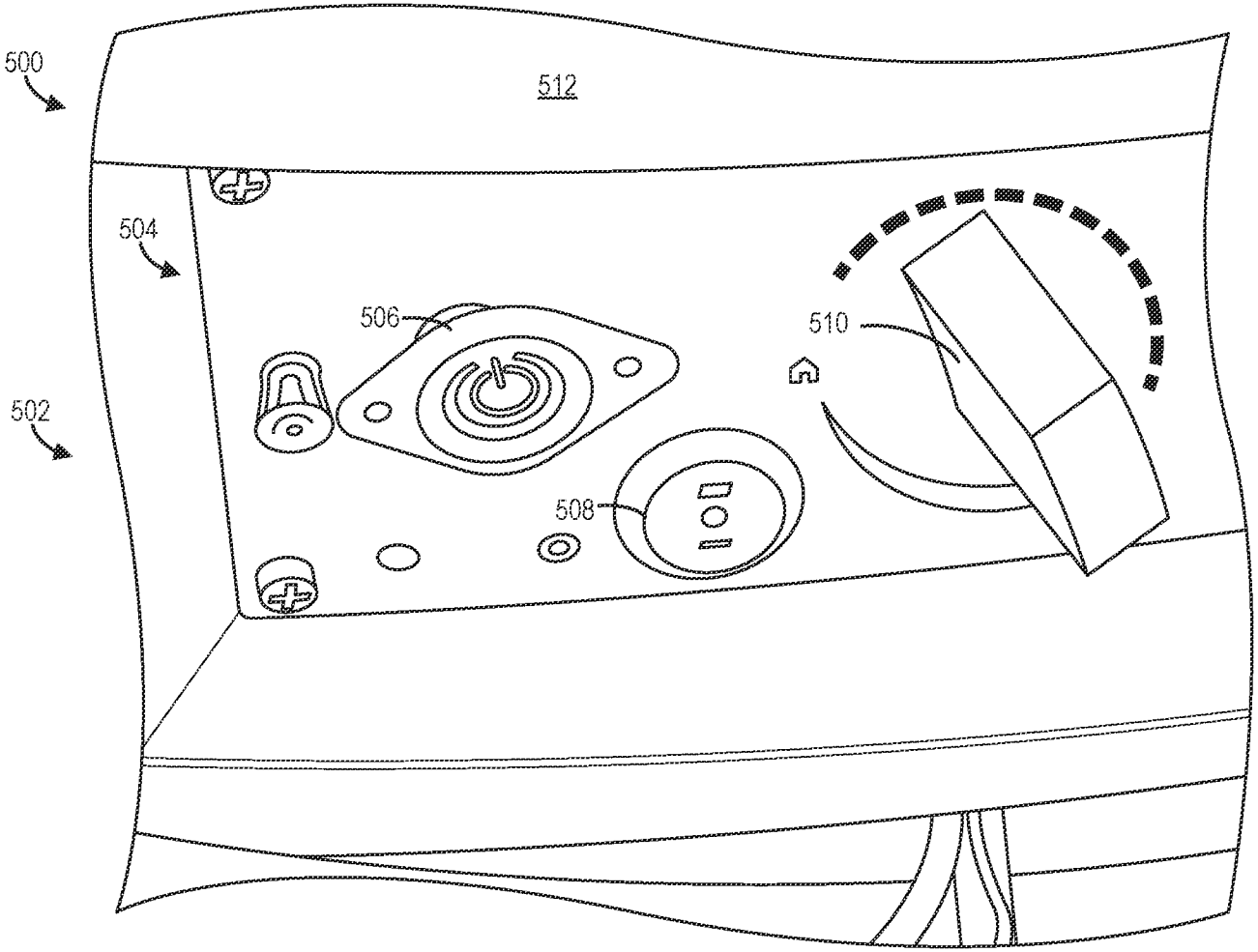
FIG. 6 shows a control panel for the fire pit, according to one or more examples of the present disclosure.

Turning now to FIG. 6, an example 500 is shown of a side view 502 of a section of a fire display device such as one of the fire pits 104 of FIG. 1. Side view 502 may include user input device 504. User input device 504 may be similar to input panel 223 as discussed above with respect to FIG. 2. User input device 504 may be coupled to an outer housing 512 of the fire display device to be readily accessed by a user. In one example, user input device 504 may be recessed into housing 512 so as to avoid accidental user inputs.

User input device 504 may include an ignite button 506, mode button 508 and dial 510. Ignite button 506 may be coupled to a controller such as controller 222 FIG. 2 respectively. Pressing ignite button 506 may send a signal to the controller to actuate an ignitor in a pilot light, as discussed above with respect to FIG. 2 and FIGS. 4A-5.

The dial 510 may be physically coupled to a mechanical valve (such as mechanical valve 258 as discussed above with respect to FIG. 2). Positions of dial 510 may control an amount of fuel passing to a fuel injection line as described above with respect FIG. 2. In an alternate embodiment where mechanical valve 258 may be controlled electronically, dial 510 may be physically and communicatively coupled to the controller. In such an example, a user input at dial 510 may instruct the controller to open or close the mechanical valve.

Mode button 508 may send a signal to the controller instructing a mode of fire display device operation. Mode button 508 may be any type of toggle switch allowing a user to toggle between three positions corresponding to three modes. The three modes may be flame off, traditional mode, and audio input mode. Traditional mode and audio input mode may correspond to different operational modes as discussed above with respect to FIG. 1. Further, the operational modes may be discussed in more detail below with respect to FIG. 6.

Figure 7:
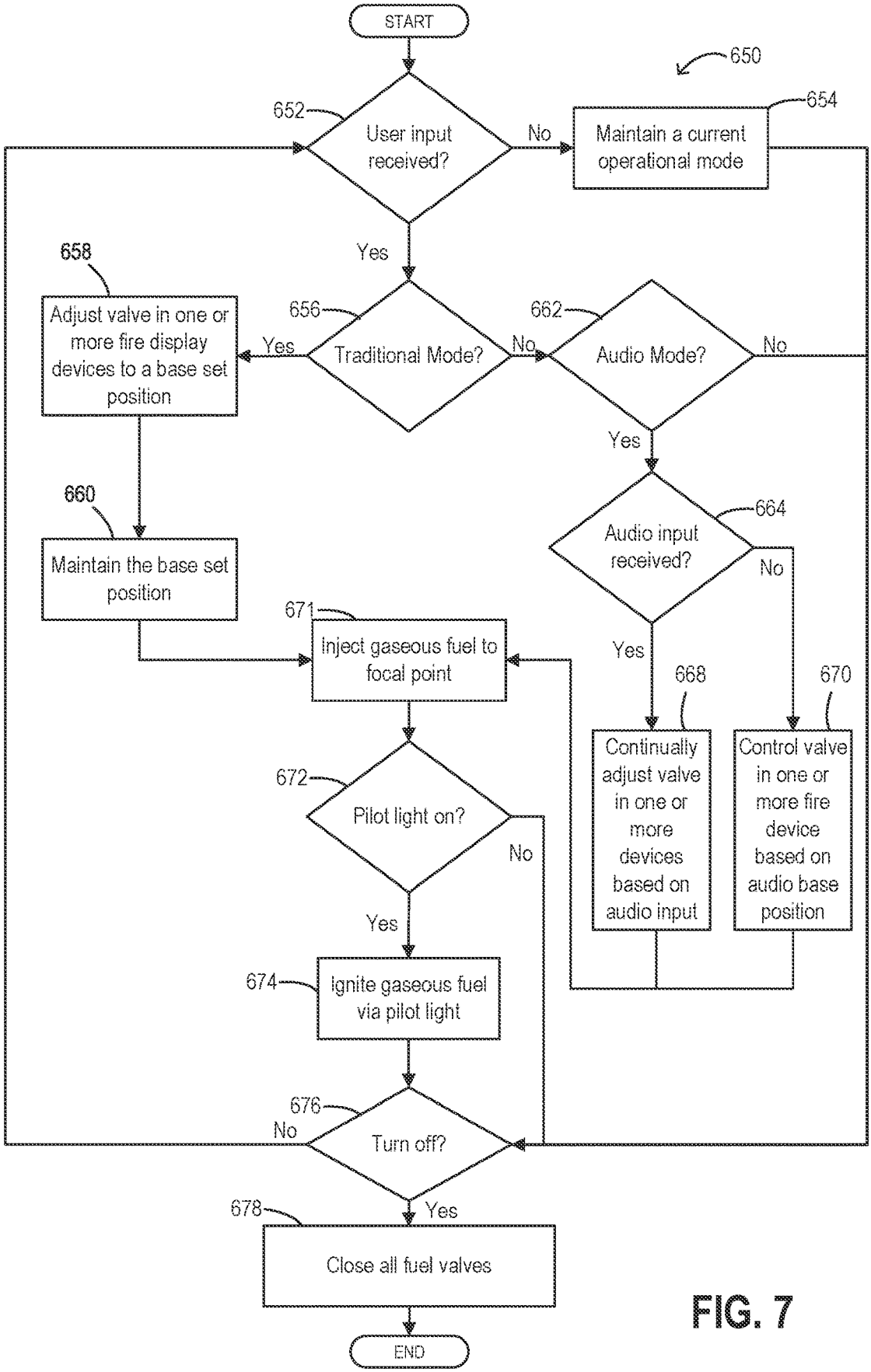
FIG. 7 is a flow chart of the method for operating a fire pit system, according to one or more examples of the present disclosure.

Turning now to FIG. 7, a flow chart of a method 650 for controlling a fire display device of the fire pit 300. Method 650 may include executable instructions included in the non-transitory memory of a control hub and/or control module communicatively coupled to the fire display device.

At 652, method 650 determines if there is a user input. A user input may be received via a user input device as described above with respect to FIG. 2 and FIG. 6. If there is not a user input, method 650 proceeds to 654 where the method maintains the current operational mode. If a user input is received, method 650 proceeds to 656 where it is determined if the user input is for traditional mode.

If the user input is for the traditional mode, a valve is adjusted in the one or more fire display devices to a base set position at 658. The adjusted valve may be a mechanical valve such as mechanical valve 258 as described above with respect to FIG. 2. In one embodiment, the adjustment may be made via a physically coupled user input such as a dial. For this example of an embodiment, the ignition fuel in a pilot light, such as pilot light 412, may be made via a physical coupled user input such as a button, such as ignite button 506. Additionally or alternatively the mechanical valve may be capable of being controlled by user input to the control module via the control hub and/or user input panel. Further a base set position of an electronic valve such as electronic valve 260 described above with respect to FIG. 2 may be set in response to user input for traditional mode. A base position of electronic valve 260 may be set by instructions from the control module. If adjusted by a control hub, the base set position of one or more fire display devices may be set simultaneously. At 660, method 650 maintains the base set position and continues to step 671.

If the user input is not for traditional mode, method 650 determines if the user input is for audio mode. If the user input is for audio mode, method 650 proceeds to 664 where it is determined if an audio input is received. If an audio input is not received, a control valve in one or more fire display devices is set to an audio base position at 670. The control valve setting the audio base position may be the electric valve as described above with respect to FIG. 2. The audio base position may be set via the control hub. If an audio input is received, the control valve may be continually adjusted in one or more devices based on audio input at 668. The audio input may be received at the one or more fire display devices via a wireless signal received by a wireless receiver from the control hub. Instructions for continual adjustment of the control valve may be given by the controller receiving the audio input from the wireless receiver. In this way the flame height in response to an audio input may be adjust at a plurality of fire display devices simultaneously. After step 668 or 670, method 650 proceeds to 671.

Returning to 662, method 650 may also proceed to 676 from 662 if the user input is not for audio mode, (e.g., 662 is No).

At step 671 gaseous fuel is injected by the fuel injectors (e.g., the fuel injectors 430, 432, 434, 436, and 438 of FIGS. 4A, 4B, and 5) into the focal point (e.g., focal point 440 of FIGS. 4A, 4B, and 5) of the burner. After fuel is injected into the focal point, the method 650 continues to 672. At 672 the pilot light, such as pilot light 412, may be on (e.g., producing a pilot light flame via an ignitor) or off (e.g., not producing a pilot light flame via an ignitor). The on or off status of the pilot light and ignitor, such as ignitor 274, may be controlled by an ignition input device, such as ignite button 506. If the pilot light is on (e.g., 672 is Yes) the method continues to 674. At 674 the flame of the pilot light may be emitted and directed along a path toward the focal point. Therein, the flame of the pilot light may ignite the fuel in the focal point generating a flame or a flame burst. For one example, if the fire pit is in traditional mode and maintained at a base set position (e.g., arriving to step 671 from 660), the flame may be a continuous flame. For another example if the fire pit is in audio mode and continually adjusted based on audio input or an audio base position (e.g., arriving to step 671 from 668 or 670), the flame may be a flame burst in a series of bursts. Wherein, the bursts of flame may be influenced by pulses of fuel created by the controller and an electronic valve influenced by audio. After 674 methods 650 may proceed to 676.

Returning to 672, if the pilot light is off (e.g., 672 is No), method 650 may continue to 676.

At 676, method 650 determines if the user input is to turn the fire display device off. If the user input is not to turn the fire display device off (e.g., 676 is No), then method 650 returns to 652. If the user input is to turn the fire display device off (e.g., 676 is Yes), method 650 continues to 678, wherein all fuel valves may be closed. All fuel valves may include both the mechanical valve, such as mechanical valve 258, and the electric valve, such as electronic valve 260. If both the mechanical valve and electrical valve are communicatively coupled to the controller, then all fuel valves may be closed at one or more fire display devices by a command from the control module. The command may be wirelessly issued to the control module by the control hub. If the mechanical valve is not communicatively coupled to the controller than closing all fuel valves may include physically closing the mechanical valve at the user input device as well as a command from the control hub.

Returning to 656, adjusting a base condition at 658 to run in in traditional mode may change the conditions of the valves, such as mechanical valve 258 and/or electronic valve 260, and flow of fuel within the fire pit. For this example, a user input may include a turn of a dial, such as dial 510, mechanically coupled to a mechanical valve, such as mechanical valve 258. Therein, the dial may adjust the mechanical valve.

For one example, an embodiment of mechanical valve, such as mechanical valve 258, may have a setting to open to the pilot portion, such as pilot portion 252*d*, and the pilot light, such as pilot light 412, and not to the fuel injection portion and burner rings, such as fuel injection portion 252*e* and burner rings 332. For this example, an embodiment of mechanical valve 258 may also have a setting to open to the pilot portion 252*d* and the pilot light 412 as well as the fuel injection portion 252*e* and burner rings 332. For this example, adjusting the dial 510 in a first direction may partially or fully open the mechanical valve 258 to the pilot portion 252*d* and pilot light 412. Turning the dial 510 further in the first direction may partially and/or fully open the mechanical valve 258 to the pilot portion 252*d* and pilot light 412 and/or the fuel injection portion 252*e* and burner rings 332. Turning the dial 510 in a second direction may partially or fully close the mechanical valve 258 to the fuel injection portion 252*e* and burner rings 332. Turning the dial 510 further in a second direction may partially and/or fully close the mechanical valve 258 to the fuel injection portion 252*e* and burner rings 332 and/or the pilot portion 252*d* and pilot light 412.

When adjusting for a base set position at 658, the mechanical valve 258 may for one example be used to adjust the output of fuel through the pilot light 412. Therein, the base set conditions may adjust size of pilot light flame, such as pilot light flame 414, sent toward the focal point, such as focal point 440, at step 674. For this example, if the mechanical valve 258 is opened greater to the pilot portion 252*d* of the split fuel passage 252, more fuel may be passed through the pilot light 412 and be ignited by the ignitor 274 at step 674. Therein increasing the size of a pilot light flame compared to the previous pilot light flame.

Additionally, for the previous example the mechanical valve 258, may also be opened to second junction, such a second junction 266*b*, allowing fuel to be passed into and through the injection portion 252*e*. Therein, gaseous fuel may be passed to the burner rings, such as burner ring 332, to be emitted by the fuel injectors, such as fuel injectors 430, 432, 434, 436, and 438, in the direction of the focal point 440. If the mechanical valve 258, is opened greater to the fuel injection portion, such as fuel injection portion 252*e*, more fuel may be passed through the burner rings and fuel injectors. Likewise, if the mechanical valve 258 is partially closed to the fuel injection, less fuel may be passed through the burner rings and the fuel injectors. For this example, fuel may be passed at a constant rate through the mechanical valve 258 unless adjusted via a new user input at 652.

At a base set position at 658, the electric valve, such as electronic valve 260, may be set to open and allow fuel to pass through the electric portion, such as electric portion 252*c*, to the injection portion, such as injection portion 252*e*, of a split fuel passages, such as split fuel passage 252. Therein, at 660 of method 650, fuel may be sent through the electronic valve 260 at a constant rate into the burner rings, such as burner rings 332, and through the fuel injectors, such as fuel injectors 430, 432, 434, 436, and 438. For one example, if the electronic valve 260 is partially opened with a greater diameter, a greater quantity of fuel may be passed through burner rings 332 and through the fuel injection ports 256. For another example, if the electronic valve 260 is partially closed, a smaller quantity of fuel may be passed through burner rings 332 and through the fuel injection ports 256.

For one example, at a base set position, the electronic valve 260 may be set to fully open, partially open, or partially close compared to a previous base set position. At 660 the base set position may be maintained, and the opening of the electronic valve 260 may be at a constant unchanging diameter unless adjusted to a new base set position through a user input at 652. Therein, at 671 of method 650, fuel may pass at a constant rate through the electronic valve 260 and be ejected toward the focal point 440 by fuel injectors, such as fuel injectors 430, 432, 434, 436, and 438.

While at 660 of method 650, the conditions described in the previous examples may be maintained unless another input is received at 652 or if the fire pit display is turned off at 676.

Returning to 664, 670 and 668 of method 650 may continuously adjust components of the fire pit, such as valves, with audio, such as music. For one example, when audio mode is engaged and method 650 proceeds to an audio base position at 670 or an audio input is detected at 668, the conditions of the electric valve, such as electronic valve 260, may be changed based on the audio played. For this example, at 670 and 668 the control module, such as control module 218, may create a protocol and send signals to change conditions in the electric valve. A change in duration, volume, or pitch of a note, may cause control module to send signals to adjust conditions of the electric valve. For example, commands from the control module 218 may fully open, partially open, partially close, fully close and/or change the diameter of the orifice of electronic valve 260 for various durations of time. Therein, signals from the control module 218 may change conditions in the electronic valve 260 may create pulses of fuel, e.g., a set quantity and duration of fuel, that pass through the injection portion, such as injection portion 252*e*, and the burner rings, such as burner rings 332. Therein at 671 of method 650, an electric valve, such as the electronic valve 260, may be influenced by music to change the quantity and duration of fuel injected toward the focal point, such as focal point 440, by the fuel injectors, such as fuel injectors 430, 432, 434, 436, and 438.

For one example, the audio detected at 668 or 670 may hold for a longer duration of time on an audio note than the previous audio note. The longer hold on a note may cause the control module 218 to send a signal to the electronic valve 260. For this example, the signal may instruct the electronic valve 260 to open for a longer period of time releasing, therein releasing a pulse of fuel for a longer duration compared to the previous pulse. For this example, the fuel pulse from the electronic valve 260 may be added to the stream of fuel from the mechanical valve 258 in the fuel injection portion 252*e*. Therein, at 671 of method 650, a larger quantity of fuel may be injected for a longer duration via fuel injectors 430, 432, 434, 436, and 438 to the focal point 440. Therein, at 674 of method 500 the pilot light flame 414 may ignite the fuel at the focal point 440 creating a larger burner flame or flame burst lasting for a longer duration.

For another example, the audio detected at 668 or 670 may have an audio note of a higher pitch than the previous audio note. The higher pitch note may cause the control module 218 to send a signal to electronic valve 260 to open wider, therein releasing a pulse of fuel that is greater in quantity and pressure than the previous pulse. For this example, the fuel pulse from the electronic valve 260 may be added to the stream of fuel from the mechanical valve 258 in the injection portion 252*e*. Therein, at 671 of method 650, a larger quantity of fuel may be injected via fuel injectors to the focal point 440. For this example, the concentration of fuel may be higher along the z-axis above and wider along the x-axis and y-axis around the focal point 440. Therein, at 674 of method 650, the larger quantity of fuel that may be ignited by a pilot light flame may produce a burner flame or flame burst that is that is higher in along the z-axis, wider along the x-axis and y-axis, greater in thermal energy, and brighter than the previous burner flame.

For another example, there may be a musical note of a higher volume than the previous note in a song. For a musical note with a higher volume, a similar procedure is followed as the previous example. For this example, if a note with a greater volume than the previous note detected, the electronic valve 260 may be opened greater releasing a larger pulse of fuel. Therein, at step 671 of method 650, a larger quantity of fuel may be injected via fuel injectors to the focal point 440. Therein, at step 674 of method 650, fuel ignited by a pilot light flame may produce a burner flame or flame burst that is that is higher in along the z-axis, wider along the x-axis and y-axis, greater in thermal energy, and brighter than the previous burner flame.

However, it is to be appreciated that these examples may be non-limiting, and other changes to the audio that may have an effect on the electronic valve have been contemplated and considered that may have an effect on the electronic valve. Additionally, for other examples the audio may have different effects on the valve. For one example, the relationship between higher and lower pitch size of fuel pulsed may be reversed. For this example, an increased pitch of an audio note may cause controller to send a signal to decrease the size of the opening of the electric valve. For this example, a note of a decrease or lower pitch may cause the electric valve to increase the size of the opening to or partially open the electric valve.

The disclosure also provides support for a method for operating a fire display device, comprising: injecting multiple gaseous fuel streams upwards to a focal point via corresponding fuel injection ports, wherein the multiple gaseous fuel streams intersect at the focal point, and igniting the multiple gaseous fuel streams at the focal point via a pilot light flame. In a first example of the method, the corresponding fuel injection ports include a plurality of fuel injection ports coupled to concentric rings. In a second example of the method, optionally including the first example, the corresponding fuel injection ports further include a post fuel injection port positioned at substantially a center of the concentric rings. In a third example of the method, optionally including one or both of the first and second examples, the post fuel injection port comprises two injection openings formed therein. In a fourth example of the method, optionally including one or more or each of the first through third examples, a first portion of the multiple gaseous fuel streams are injected via a first group of the corresponding fuel injection ports, wherein the first group of the corresponding fuel injection ports are coupled to an inner burner ring. In a fifth example of the method, optionally including one or more or each of the first through fourth examples, gaseous fuel is flowed through the inner burner ring prior to being injected as the first portion of the multiple gaseous fuel streams. In a sixth example of the method, optionally including one or more or each of the first through fifth examples, the method further comprises: swirling air around the focal point via deflection panels coupled to the fire display device. In a seventh example of the method, optionally including one or more or each of the first through sixth examples, the multiple gaseous fuel streams are injected at greater than a threshold rate. The disclosure also provides support for a fire display device, comprising: a plurality of fuel injection ports coupled to at least one burner ring, a post fuel injection port positioned at substantially a center of the at least one burner ring, wherein the plurality of fuel injection ports and the post fuel injection port are configured to inject gaseous fuel upwards to a focal point, and a pilot light configured to direct a pilot light flame to the focal point. In a first example of the system, the at least one burner ring comprises multiple concentric rings, wherein the multiple concentric rings are tubular rings that include an outer ring and an inner ring, and wherein the outer ring and the inner ring are fluidically coupled to each. In a second example of the system, optionally including the first example, the focal point is vertically above the at least one burner ring and the plurality of fuel injection ports. In a third example of the system, optionally including one or both of the first and second examples, the focal point is directly above the post fuel injection port. In a fourth example of the system, optionally including one or more or each of the first through third examples, the system further comprises: a plurality of deflection panels arranged to form a substantially spiral shape with channels defined between the plurality of deflection panels. In a fifth example of the system, optionally including one or more or each of the first through fourth examples, the at least one burner ring is positioned on top of a burner pan, and wherein a plurality of deflection panels are further coupled to the top of the burner pan. In a sixth example of the system, optionally including one or more or each of the first through fifth examples, the system further comprises: a controller, wherein the controller comprises instructions stored in non-transitory memory that are executable to: receive an audio input, and adjust an amount of the gaseous fuel injected to the focal point based on the audio input. The disclosure also provides support for a fire display device, comprising: at least one burner ring coupled to a burner plate, a plurality of fuel injection ports coupled to the at least one burner ring, each of the plurality of fuel injection ports configured to inject a separate gaseous fuel stream to a focal point above the plurality of fuel injection ports, a post fuel injection port positioned substantially at a center of the at least one burner ring, at least one opening formed into the burner plate, and a pilot light configured to provide a pilot light flame that intersects with the focal point. In a first example of the system, the system further comprises: deflection panels, wherein the deflection panels are coupled to the burner plate, and wherein the deflection panels are arranged in a substantially spiral configuration. In a second example of the system, optionally including the first example, each of the plurality of fuel injection ports are angled upward and extend towards the focal point. In a third example of the system, optionally including one or both of the first and second examples, the plurality of fuel injection ports are configured to inject the separate gaseous fuel streams at greater than a threshold rate. In a fourth example of the system, optionally including one or more or each of the first through third examples, the plurality of fuel injection ports are positioned substantially equidistantly around the at least one burner ring.

FIGS. 3-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Note that the example control and estimation routines included herein can be used with various system configurations. The control methods and routines disclosed herein may be stored as executable instructions in non-transitory memory and may be carried out by the control system including the controller in combination with the various sensors, actuators, and other hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the control system, where the described actions are carried out by executing the instructions in a system including the various hardware components in combination with the hub controller and/or the fire device controller.

It will be appreciated that the configurations and routines disclosed herein are exemplary in nature, and that these specific embodiments are not to be considered in a limiting sense, because numerous variations are possible. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified. As used herein, the term "substantially" is construed to mean plus or minus five percent of the range unless otherwise specified.

It is also to be understood that the specific assemblies and systems illustrated in the attached drawings, and described in the following specification are exemplary embodiments of the inventive concepts defined herein. For purposes of discussion, the drawings are described collectively. Thus, like elements may be commonly referred to herein with like reference numerals and may not be re-introduced. FIGS. 3-6 are shown approximately to scale. FIGS. 3-6 may be used to represent other relative dimensions.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating a fire display device, comprising:

injecting multiple gaseous fuel streams upwards to a focal point via corresponding fuel injection ports, wherein the multiple gaseous fuel streams intersect at the focal point, and wherein the fuel injection ports comprise individual fuel injectors arranged in at least a first inner ring and a second concentric outer ring in a horizontal plane;

igniting the multiple gaseous fuel streams at the focal point via a pilot light flame, wherein the focal point is vertically above the individual fuel injectors; and swirling air around the focal point via deflection panels coupled to the fire display device, the deflection panels are positioned between the first inner ring and the second concentric outer ring.

2. The method of claim 1, wherein the corresponding fuel injection ports include a plurality of fuel injection ports coupled to concentric rings.

3. The method of claim 2, wherein the corresponding fuel injection ports further include a post fuel injection port positioned at substantially a center of the concentric rings.

4. The method of claim 3, wherein the post fuel injection port comprises two injection openings formed therein.

5. The method of claim 1, wherein a first portion of the multiple gaseous fuel streams are injected via a first group of the corresponding fuel injection ports, wherein the first group of the corresponding fuel injection ports are coupled to an inner burner ring.

6. The method of claim 5, wherein gaseous fuel is flowed through the inner burner ring prior to being injected as the first portion of the multiple gaseous fuel streams.

7. The method of claim 1, wherein the deflection panels are coupled via one or more of magnets.

8. The method of claim 1, wherein the multiple gaseous fuel streams are injected at greater than a threshold rate.

9. A fire display device, comprising:

a plurality of fuel injection ports coupled to at least one burner ring;

a post fuel injection port positioned at substantially a center of the at least one burner ring, wherein the plurality of fuel injection ports and the post fuel injection port are configured to inject gaseous fuel upwards to a focal point; and a pilot light configured to direct a pilot light flame to the focal point, wherein the at least one burner ring comprises multiple concentric rings having a plurality of angled injectors forming the plurality of fuel injection ports, wherein the multiple concentric rings are tubular rings that include an outer ring and an inner ring, and wherein the outer ring and the inner ring are fluidically coupled to each via a plurality of tubular spokes with fuel injectors on the tubular spokes, wherein the focal point is vertically above the burner rings and the plurality of fuel injection ports on the rings and the fuel injection ports on the spokes and the pilot light, wherein the focal point is directly above the post fuel injection port, and where the plurality of fuel injection ports on the rings and the fuel injection ports on the spokes and the pilot light are directed to the focal point.

10. The fire display device of claim 9, wherein the pilot lit is positioned separated from each of the plurality of rings and separated from each of the spokes, but between two adjacent rings.

11. The fire display device of claim 9, further comprising a plurality of deflection panels arranged to form a substantially spiral shape with channels defined between the plurality of deflection panels.

12. The fire display device of claim 11, wherein the at least one burner ring is positioned on top of a burner pan, and wherein a plurality of deflection panels are further coupled to the top of the burner pan.

13. The fire display device of claim 12, further comprising a controller, wherein the controller comprises instructions stored in non-transitory memory that are executable to:

receive an audio input; and adjust an amount of the gaseous fuel injected to the focal point based on the audio input.

* * * * *